US005282570A

United States Patent [19]

Johnson et al.

[11] Patent Number: 5,282,570

[45] Date of Patent: Feb. 1, 1994

[54] ELECTRONICALLY CONTROLLED ACCUMULATOR INJECTOR

[75] Inventors: Roger N. Johnson, Hagaman, N.Y.; Bertrand D. Hsu, Erie, Pa.

[73] Assignee: General Electric Company, Schenectady, N.Y.

[21] Appl. No.: 881,964

[22] Filed: May 12, 1992

[51] Int. Cl.[5] ..... F02M 47/02

[52] U.S. Cl. ..... 239/5; 239/73; 239/89; 239/92; 239/533.4

[58] Field of Search ..... 239/89, 92, 96, 71, 239/73, 533.8, 533.3, 533.4, 5

[56] References Cited

U.S. PATENT DOCUMENTS 2,283,725 5/1942 Eichelberg ..... 239/533.8
2,946,513 7/1960 Sampietro ..... 239/92
3,409,226 11/1968 Steiger ..... 239/533.8
4,356,979 11/1982 Dobler ..... 239/73
4,662,564 5/1987 Okuda ..... 239/73

FOREIGN PATENT DOCUMENTS 66556 9/1950 Netherlands ..... 239/92

*Primary Examiner*—Andres Kashnikow
*Assistant Examiner*—Christopher G. Trainor
*Attorney, Agent, or Firm*—Paul R. Webb, II

[57] ABSTRACT

This invention relates to accumulator injectors for a gas and/or liquid fueled diesel engine fuel injection system. Such structures of this type, generally, allows for variable injection timing and duration while providing a multiple fuel capability by changing the fuel distribution/atomization nozzle.

7 Claims, 1 Drawing Sheet

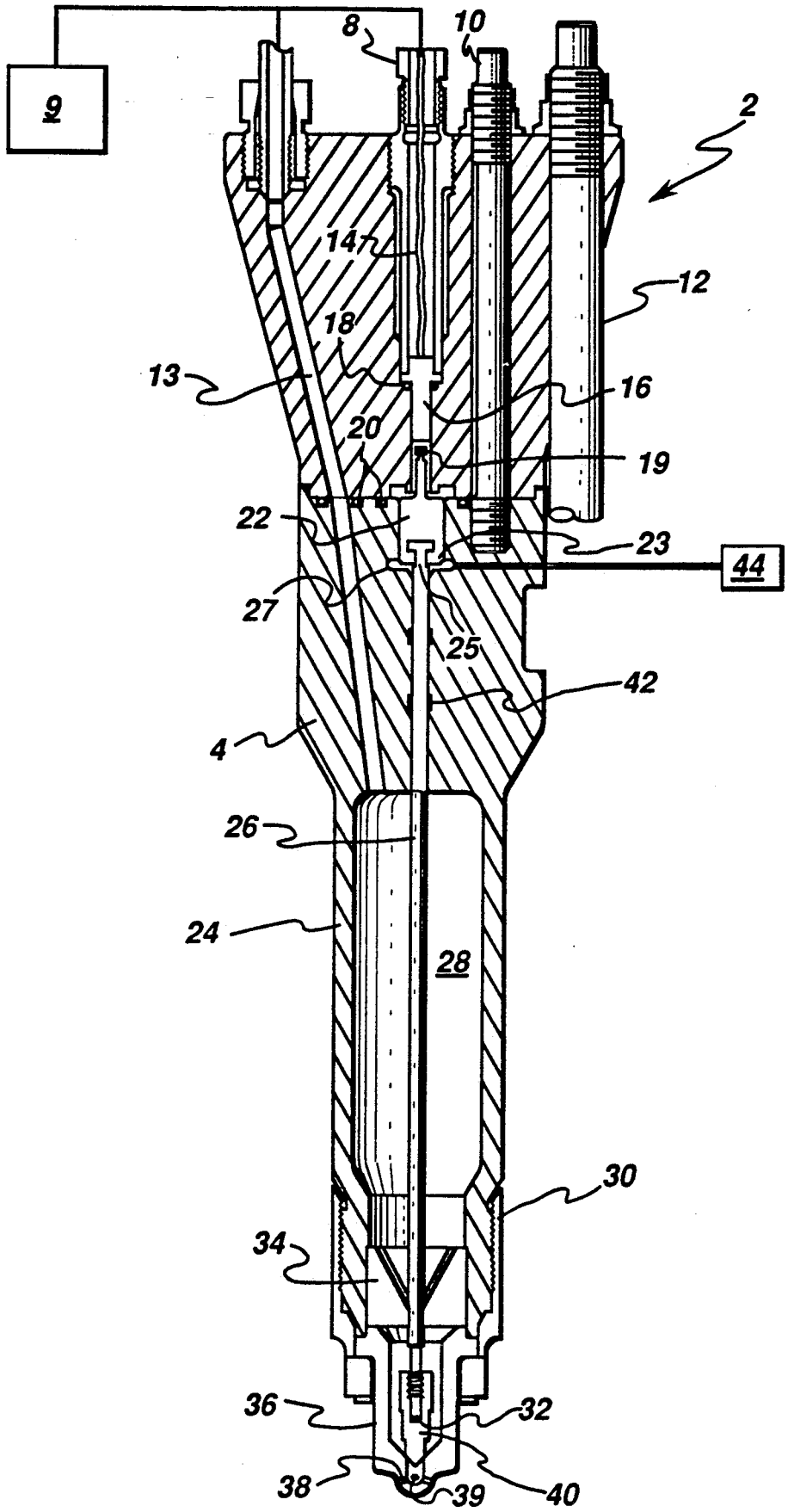
9
8
10
2
14
12
18
13
16
20
19
22
23
44
27
25
42
4
26
24
28
30
34
36
32
38
39
40

ELECTRONICALLY CONTROLLED ACCUMULATOR INJECTOR

BACKGROUND OF THE INVENTION

1. Field of the Invention

This invention relates to accumulator injectors for a gas and/or liquid fueled diesel engine fuel injection system. Such structures of this type, generally, allow for variable injection timing and duration while providing a multiple fuel capability by changing the fuel distribution/atomization nozzle.

2. Description of the Related Art

It is known in fuel injectors to make use of a pressure actuated, dual fuel-type injector which employs a mechanical spring to provide the proper needle seating force. The nozzle valve of the fuel injector is a pintle type, which typically has sealing difficulties due to exposure to the combustion chamber and the relatively large sealing surface required in the pintle type nozzle valve. Also, it is known in fuel injectors to employ a pressure actuated injector which utilizes a combination of a mechanical spring and fluid pressure for proper needle closing and sealing. However, with this type of pressure actuated injector, the fluid used in the injector is the same fluid that is used for preventing gas flow past the injector needle, which limits the operating pressure range. Therefore, a more advantageous fuel injection system, then, would be presented if the fuel injector pressure could be more independently controlled.

Finally, it is known, in fuel injectors, to employ an electronically controlled fuel injector which uses a direct acting solenoid to lift the needle valve. However, this injector utilizes a mechanical spring and requires a reduction of the fuel pressure to produce a timely closing of the needle. Consequently, further electronic controls of the fuel injector pressure while maintaining a relatively constant fuel injector pressure would be advantageous.

It is apparent from the above that there exists a need in the art for an accumulator injector which allows for variable injection timing and duration, and which at least equal the fuel injection characteristics of the known fuel injectors, but which at the same time is capable of injecting gaseous or liquid fuels over a broad range of fuel pressures. It is a purpose of this invention to fulfill this and other needs in the art in a manner more apparent to the skilled artisan once given the following disclosure.

SUMMARY OF THE INVENTION

Generally speaking, this invention fulfills these needs by providing an electronically controlled accumulator injector, comprising a fuel injector housing means, a servo valve means rigidly attached to said housing means, a reciprocating needle rod means located substantially within said housing means such that said rod means includes a first end and a second end, an accumulator chamber means located substantially within said fuel injector housing means and adjacent to said first end of said rod means, a reciprocation sensing means rigidly attached to said second end of said rod means, and an electronic drive means connected to said servo means and said sensing means.

In certain preferred embodiments, compressed gas and/or petroleum based or coal water slurry liquid fuels are used in the injector. Also, the servo valve means reciprocates the needle rod means. Also, the fuel is stored in the accumulator chamber. Finally, fuel is stored at the desired injection pressure in the accumulator chamber and is admitted to the combustion chamber via orifices in a nozzle by opening the valve at end of needle rod.

In another further preferred embodiment, when used with gaseous fuels, the accumulator injector allows for a relatively constant fuel pressure in the injector over a broad range of fuel supply pressures.

The preferred injector, according to this invention, offers the following advantages: good stability; good durability; substantially constant fuel pressure with gaseous fuels; the ability to use gaseous or liquid fuels; increased range of fuel pressure; variable injection timing and duration; good economy; low engine emissions; and high strength for safety. In fact, in many of the preferred embodiments, these factors of multiple fuel capability, increased range of fuel pressures, and variable injection timing and duration are optimized to an extent that is considerably higher than heretofore achieved in prior, known fuel injectors.

BRIEF DESCRIPTION OF THE INVENTION

The subject matter which is regarded as the invention is particularly pointed out and distinctly claimed in the concluding portion of the specification. The invention, however, may be best understood by reference to the following description taken in conjunction with the accompanying drawing Figure in which FIG. 1 is a side plan view of an electronically controlled accumulator injector, according to the present invention.

DETAILED DESCRIPTION OF THE INVENTION

With respect to the single Figure, there is illustrated electronically controlled accumulator injector 2. Injector 2 includes, in part, upper housing 4, electrical feed inlet 8, conventional electronic drive 9, needle rod lift sensor 16, lower housing 24, needle rod 26, accumulator chamber 28, nozzle 36 needle tip 40 and conventional servo valve 44. In particular, housing 4 is, preferably constructed of any suitable heat treated alloy steel. A conventional servo valve 44 is rigidly connected to housing 4 by a conventional connection. Electrical feed inlet 8 is rigidly attached to housing 4 by a conventional threaded fastener. A conventional fastener 10 rigidly attaches housing 4 to lower housing 24. A conventional stud 12 rigidly attaches injector 2 to a conventional cylinder head (not shown).

Located within housings 4 and 24 is a conventional fuel inlet 13. Conventional electrical leads 14 are attached by a conventional solder joint (not shown) to a needle lift sensor 16. A conventional elastomeric O-ring 18 is located between sensor 16 and upper housing 4 in order to prevent backing fluid leakage from around sensor 16. Conventional elastomeric O-rings 20 are located between upper housing 4 and lower housing 24 in order to prevent fuel leakage from between housing 4 and 24.

Needle rod 26 is located in lower housing 24. An actuator piston 22 is attached to rod 26 by rails 23 on piston 22 and slots 25 on rod 26. Magnet 19 is rigidly attached to the top of piston 22 by a conventional attachment. Oil "plenum" or "chamber" or "region" 27 is located below piston 22. Accumulator chamber 28 is located within housing 24. Piston 22 and magnet 19 act substantially like a conventional Hall effect device in injector 2. A conventional fuel injector cap 30 is used to secure nozzle 36 to lower housing 24. A shim 32 is located on the bottom of needle rod 26 to provide the proper lift of needle tip 40. A conventional needle rod guide 34 is located between chamber 28 and needle tip 40. Nozzle 36 also includes nozzle orifices 38 and plenum 39. Lower housing 24, needle rod 26, cap 30, shim 32, guide 34, nozzle 36 and needle tip 40, preferably, are constructed of any suitable heated treated alloy steel.

During the operation of injector 2, fuel is charged into accumulator chamber 28. At the correct time, relative to the position of a piston (not shown) a signal is sent by electronic device 9 to servo valve 44 which, in turn, directs pressurized oil to the oil plenum or chamber or region 27 of actuator piston 22 causing the needle 40 to lift. Fuel flows into the nozzle plenum 39 and through orifice holes 38 into the combustion chamber of the gas fueled diesel engine (not shown). At the end of injection, the pressure in oil plenum 27 is relieved, whereupon the pressurized backing (over pressure) fluid causes needle 40 to close against the seat of nozzle 36. To illustrate its versatility, the same injector has successfully injected liquid fuels at 12 KPSI, and gaseous fuels at 4 KPSI. Gas tight sealing at the nozzle valve is achieved because of the relatively large nozzle seating stress produced by the backing fluid vs. the pressure of the fuel, and the presence of an oil film from the purge oil.

Having an accumulator chamber adjacent to the nozzle eliminates pressure waves common in pressure actuated injectors which can cause chatter and subsequent leakage and erosion at the nozzle 36. When operating with liquid fuels using a conventional engine camshaft driven positive displacement pump (not shown) it is preferred that a conventional check valve (not shown) is used between the pump and injector. This check valve can remain in the system when using compressed gas supplied from a constant pressure source.

It is noted that in order to change from one type fuel to another, it is only necessary to change the atomizing nozzle 36 by conventional techniques to obtain the correct hole size or, for the case of fuels containing abrasives (i.e., coal water slurry), to provide orifices through conventional ultrahard, abrasion resistant materials.

Once given the above disclosure, many other features, modification or improvements will become apparent to the skilled artisan. Such features, modifications or improvements are, therefore, considered to be a part of this invention, the scope of which is to be determined by the following claims.

What is claimed is:

1. An electronically controlled accumulator injector, said injector comprised of:

a fuel injector housing means;

a servo valve means rigidly attached to said housing;

a reciprocating needle rod means substantially located within said housing means such that said rod means includes a first end and a second end;

an accumulator chamber means substantially located within said fuel injector housing means and adjacent to said first end of said rod means;

a reciprocation sensing means rigidly attached to said second end of said rod means; and an electronic drive means electrically connected to said servo valve means and said sensing means.

2. The injector, according to claim 1, wherein said housing means is further comprised of:

an upper housing means; and a lower housing means.

3. The injector, according to claim 1, wherein said reciprocation sensing means is further comprised of:

an actuator piston means; and a magnet rigidly attached to said actuator piston means.

4. A method for electronically controlling an accumulator injector having a fuel injector housing means, a servo valve means, a needle rod means having a needle tip, an accumulator chamber means, a nozzle means having a plenum and an orifice, a sensing means having an actuator piston, and an electronic drive means, wherein said method is comprised of the steps of:

charging a combustible fuel into said chamber means;

operating said electronic drive means at a predetermined time to cause said servo valve means to direct an oil at a predetermined pressure to an underside of said actuator piston;

lifting said needle tip;

sensing said needle tip lift by said sensing means;

flowing said combustible fuel into said nozzle plenum;

flowing said combustible fuel through said nozzle orifice;

relieving said predetermined pressure of said oil which is in contact with said underside of actuator piston;

lowering said needle tip against said nozzle and sensing said lowering of said needle tip by said sensing means.

5. The method, according to claim 4, wherein said combustible fuel is further comprised of:

a compressed gas.

6. The method, according to claim 4, wherein said combustible fuel is further comprised of:

a petroleum based liquid fuel.

7. The method, according to claim 4, wherein said combustible fuel is further comprised of:

a coal water slurry liquid fuel.

* * * * *